US006120196A

United States Patent [19]

Matsuda

[11] Patent Number: 6,120,196

[45] Date of Patent: Sep. 19, 2000

[54] IMAGE FORMING DEVICE USING MULTIPLE FACTORS TO ADJUST PRINT POSITION

[75] Inventor: Yuji Matsuda, Tokyo, Japan

[73] Assignee: Copyer Co., Ltd., Tokyo, Japan

[21] Appl. No.: 09/125,633

[22] PCT Filed: Feb. 24, 1997

[86] PCT No.: PCT/JP97/00506

§ 371 Date: Aug. 21, 1998

§ 102(e) Date: Aug. 21, 1998

[87] PCT Pub. No.: WO97/30851

PCT Pub. Date: Aug. 28, 1997

[30] Foreign Application Priority Data

Feb. 23, 1996 [JP] Japan ..... 8-036772

[51] Int. Cl.[7] ..... B41J 11/20

[52] U.S. Cl. ..... 400/55; 400/58; 400/582; 400/56

[58] Field of Search ..... 400/55, 56, 582, 400/58; 395/101–119

[56] References Cited

U.S. PATENT DOCUMENTS

| | | | |
|---|---|---|---|
| 5,088,848 | 2/1992 | De Falco et al. | 400/630 |
| 5,257,867 | 11/1993 | Ito et al. | 400/56 |
| 5,316,395 | 5/1994 | Imai | 400/56 |
| 5,499,876 | 3/1996 | Hosokawa et al. | 400/56 |
| 5,618,120 | 4/1997 | Ishikawa | 400/708 |
| 5,806,992 | 9/1998 | Ju | 400/56 |

FOREIGN PATENT DOCUMENTS

| | | |
|---|---|---|
| 0 526 154 | 2/1993 | European Pat. Off. . |
| 2-155783 | 6/1990 | Japan . |
| 4-250086 | 2/1992 | Japan . |
| 4-163180 | 6/1992 | Japan . |
| 4-223182 | 8/1992 | Japan . |
| 4-247973 | 9/1992 | Japan . |
| 4-339203 | 11/1992 | Japan . |
| 5-32026 | 2/1993 | Japan . |
| 5-104710 | 4/1993 | Japan . |
| 4-141422 | 5/1993 | Japan . |
| 6-56307 | 3/1994 | Japan . |

*Primary Examiner*—John S. Hilten
*Assistant Examiner*—Charles H. Nolan, Jr.
*Attorney, Agent, or Firm*—Dellett and Walters

[57] ABSTRACT

According to the type of paper sheet specified through an operation unit (111) by the user, the environmental temperature detected by a thermistor (110), and the spacing between the paper sheet and a paper sensor, detected by a lift height sensor (113), respectively, the correction values for the start and end positions where the printing heads start and end the printing in a horizontal direction are beforehand stored in a memory (112). Before printing, a CPU (104) detects the paper edge positions of the paper sheet on the basis of the output from a paper sensor (303), and reads the corresponding correction values from the memory (112) according to the type of paper sheet, the environmental temperature and the lift height. A window control unit (106) corrects the paper edge position with the correction values, thereby generating a window signal which controls the side margins of the paper sheet. In accordance with the window signal, a head control unit (105) controls the heads (103) for the respective colors to precisely determine printable regions extending horizontally from the printing start positions to the printing end positions.

25 Claims, 15 Drawing Sheets

FIG.4 (a)

401

| AMBIENT TEMP. (° C) | CORRECTION AMOUNT Ct (dots) |
|---|---|
| 40 | +8 |
| 35 | +6 |
| 30 | +4 |
| 25 | +2 |
| 20 | ±0 |
| 15 | −2 |
| 10 | −4 |
| 5 | −6 |
| 0 | −8 |

FIG.4 (b)

402

| TYPE OF PAPER | CORRECTION AMOUNT Cp (dots) |
|---|---|
| OHP | +4 |
| COATED | +2 |
| NORMAL | ±0 |
| INTERMED. | −2 |
| FILM | −4 |

FIG.4 (c)

403

| LIFT HEIGHT | CORRECTION AMOUNT Ch (dots) |
|---|---|
| −1 | +4 |
| 0 | ±0 |
| +1 | −4 |

IMAGE FORMING DEVICE USING MULTIPLE FACTORS TO ADJUST PRINT POSITION

TECHNICAL FIELD

The present invention relates to an image forming device, and particular to such a device comprising a recording head which is scanned in a direction perpendicular to the travelling direction of a recording medium.

BACKGROUND ART

One type of such image forming devices is a device which employs an ink jet recording system. In the ink jet recording system, a nozzle filled with ink from an ink tank is provided with a heater which is heated in response to a heating pulse signal to thereby produce an air bubble, the pressure of which acts to eject an ink drop from the nozzle. In an image forming device employing the ink jet recording system, a plurality of nozzles are disposed in a line to form a recording head which is scanned to record an image.

As shown in FIG. 9, a recording head 103 (hereinafter referred to as simply a head) mounted on a carriage is scanned in a main scanning direction (X) to perform a printing on a paper sheet 15 column by column (17), so that a multitude of such columns are successively printed to achieve the printing of a band. Then, the paper sheet 15 is travelled in a sub-scanning direction (Y) to perform the printing of a second band next to the first band. This process is iterated so as to form an image constituted by the multitude of bands.

In recent years, a plurality of heads of different ink colors (e. g., cyan, magenta, yellow and black, etc.) are used together so that the different colors of ink are superimposed to form a full-color image. The full-color image requires printed positions of the respective colors (ink ejected positions) to be precise. For this purpose, usually as shown in FIG. 10, a linear scale 301 having slits 304 for every dot position formed therealong and a linear sensor 302 for optically detecting the presence/absence of the slit are used for providing the synchronization for ejecting ink drops, while counting pulse outputs (corresponding to the slits) from the linear sensor 302 for calculating a distance travelled by the head, thereby recognizing the exact positions to be printed on.

Also, the presence/absence of a paper sheet is detected with a paper sensor 303 which is mounted near the heads. As shown in FIG. 11, the paper sensor 303 is scanned on a paper sheet together with a carriage 120. When the paper sensor sequentially detects the left and right edges of the paper sheet, slit-count values are read out which are obtained by counting the output pulses from the linear sensor 302 and which correspond to the respective distances travelled from a reference position, thereby recognizing where in the horizontal direction and what size of paper sheet has been loaded. For such a paper sensor 303, usually a light-reflection type sensor is used which emits light outwardly and detects any reflected light.

In the present specification, the left and right edges of the paper sheet correspond respectively to the left and right sides when viewed from the upstream of the transfer of the paper sheet. Thus, it should be noted that the left and right are opposite to those when viewed from the front of the device.

In forming an image on a paper sheet, the print start and end positions, i.e., margins in the horizontal direction, are determined according to a current position of the paper sensor 303 and the respective heads, based on the position of the paper sheet (count values of the slits of the linear scale 301), taking into consideration a margin from the paper edge Pe and distances of the respective heads from the paper sensor. For example, in FIG. 11, suppose that "A" is a distance between the paper edge position Pe and the paper sensor 303 at the reference position and an amount of margin Z is to be obtained. Then, when the paper sensor 303 reaches a position Pk of [A+Z+X] the printing is started with the K head (black head being the first one in the printing direction). Then, when the paper sensor 303 reaches a position Pc of [A+Z+X+Y1] the printing is started with the C head (cyan head being the second one in the printing direction). Further, when the paper sensor 303 reaches a position Pm of [A+Z+X+Y1+Y2] the printing is started with the M head (magenta head being the third one in the printing direction). Likewise, when the paper sensor 303 reaches a position Py of [A+Z+X+Y1+Y2+Y3] the printing is started with the Y head (yellow head being the fourth one in the printing direction). In this way, adequate margins are ensured and the print start positions of the heads are controlled to be at the same position (Ps).

When performing two-way printing, the similar control also applies to the back path.

Instead of the combination of the linear scale 301 and the linear sensor 302, an alternative means to determine the image start position at the edge of a paper sheet can be realized by counting moving steps of a motor which drives the carriage 20 to move in the X direction.

In the meantime, paper (recording medium) includes normal paper, coated paper, film paper, intermediate paper (tracing paper), etc. and the light reflectance differs depending upon the characteristics of the paper. Now, assume that as shown in FIG. 12, a fixed threshold level (represented by a dashed line) Th is used for a binary conversion to detect a paper sheet with respect to an output from the light reflective type paper sensor 303. In this case, the output level of the sensor will vary depending upon the magnitude of the reflectance. For example, as compared to the sensor output Son with respect to the normal paper which exhibits a normal level of reflectance, the sensor output Sol for paper of a lower reflectance will decrease in its output level. This results in that the binary signal Bl for the paper of the lower reflectance will rise later than the binary signal Bn of the sensor output for the normal paper. Opposite to this, the binary signal Bh for the paper of a higher reflectance will rise earlier than the binary signal Bh for the paper of the normal reflectance. As a result, as shown in FIG. 13, the print start position in the horizontal direction X (main scanning direction of the head 103) for the lower reflectance paper (FIG. 13(*b*)) will be ahead of that of the normal paper (FIG. 13(*a*)), and the print start position in the horizontal direction X for the higher reflectance paper (FIG. 13(*c*)) will be behind of that of the normal paper. This will cause the margins Z1, Z2 and Z3 from the paper edge Pe to the print start positions to vary depending upon the type of paper. In this way, inaccurately detected position of the paper edge affects the accuracy of the margins.

Even when the same type of paper is used, the sensor output level will vary with an ambient temperature depending upon the temperature characteristics of the receiving element of the sensor. This can make the detected position of the paper edge incorrect, changing the margins.

Further, some types of paper could swell and heave as the print density increases, causing the heads to rasp the surface of the paper sheet. To overcome this, there is a device of a type in which a user can arbitrarily adjust the spacing between the heads and the paper sheet. In this type of the device, the paper sensor 303, which is mounted near the heads, will change in its height together with the heads. Thus, the change of the spacing between the paper sheet and the paper sensor 303 will cause the amount of incident light of the sensor to vary, changing its output level so that the detected position of the paper edge becomes inaccurate to change the margins.

It is, therefore, an object of the present invention to provide an image forming device capable of accurately detecting a paper edge position even when states of events change, which causes an output deviation of a recording medium detection means such as a paper sensor.

It is another object to provide an image forming device capable of accurately defining a horizontal margin by accurately detecting a paper edge position.

DISCLOSURE OF THE INVENTION

According to the invention, there is provided an image forming device comprising a carriage for mounting thereon a recording head, the carriage being scanned in a direction perpendicular to a travelling direction of a recording medium; a recording medium detection means for detecting a side edge of the recording medium, based on a change in a detected output when scanned in the direction perpendicular to the travelling direction of the recording medium; an event state detection means for detecting a state of an event which is a factor fluctuating the output of the recording medium detection means; a correction value storage means for storing correction values to correct the output of said recording medium detection means based on different states of the event detected by said event state detection means; a correction means for, when recording with the recording head, obtaining one of the correction values corresponding to a state of the event detected by the event detection means, from the correction value storage means, and for correcting, with the correction value, the output from the recording detection means.

The recording medium detection means, for example, includes a detector which emits light outward and outputs an electrical signal responsive to an amount of reflected light and a binary conversion circuit which converts an output of the detector into a binary signal.

The event state detection means, for example, may be means for detecting an ambient temperature of the image forming device.

Alternatively, the event state detection means may be means for detecting a type of the recording medium which is set up by a user. Instead, it may also be means for detecting a spacing between the recording medium and the detector.

The image forming device, preferably, further includes a margin control means for controlling, when scanning the recording head in the direction perpendicular to the travelling direction of the recording medium, a margin in the head scanning direction by defining at least a print start position, the margin control means controlling the margin based on the output of the recording medium detection means corrected by the correction means.

The detector may be fixedly mounted on the carriage. This allows the detector to scanned together with the scanning of the carriage, eliminating the need of a mechanism dedicated to scan the detector.

The image forming device according to the invention may also include means for adjusting a spacing between the carriage and the recording medium. With this means, in a case where a plurality of heads are mounted on the carriage, an adjustment can be achieved so that all the respective spacings between the heads and the recording medium are equally adjusted. In this case, the spacing between the detector and the recording medium also changes at the same time. According to the invention, even when a change occurs in the state of the type of paper, the ambient temperature, the spacing between the recording medium and the detector, etc., it is possible to accurately detect a paper edge position and at least start a printing with an accurate margin.

BRIEF DESCRIPTION OF THE DRAWINGS

FIGS. 4(*a*), 4(*b*) and 4(*c*) shows examples of correction amounts for a horizontal printing position with respect to various factors as shown in FIGS. 3(*a*), 3(*b*) and 3(*c*): the ambient temperature, the type of paper and the lift height, respectively;

DESCRIPTION OF THE PREFERRED EMBODIMENTS

Now, the present invention will be described in detail with reference to the illustrated embodiment. The same numerals are used for elements similar to those described hereinbefore and the duplicate explanation will be omitted.

In the embodiment, as one of image forming devices, there is explained an ink jet image forming device with a plurality of color heads. However, the invention is not limited to this, but is applicable to any type of image forming device if the device has a head, which is scanned in the direction perpendicular to the paper travelling direction, and a sensor to detect a side edge position of a paper sheet (the output of which varies depending upon a type of paper).

Figure 1:
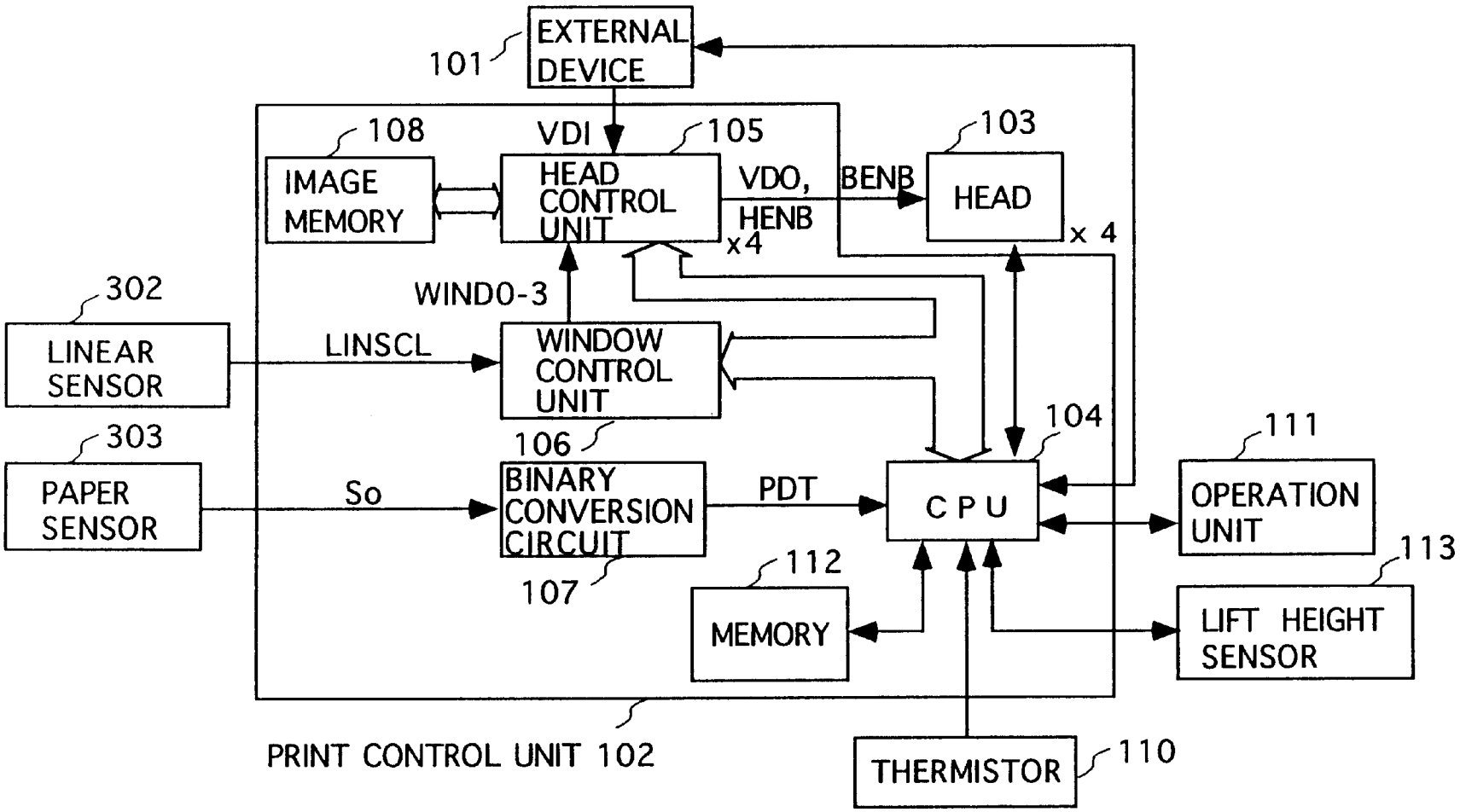
FIG. 1 is a block diagram showing a configuration of an ink-type image forming device as an embodiment according to the invention.
Figure 2:
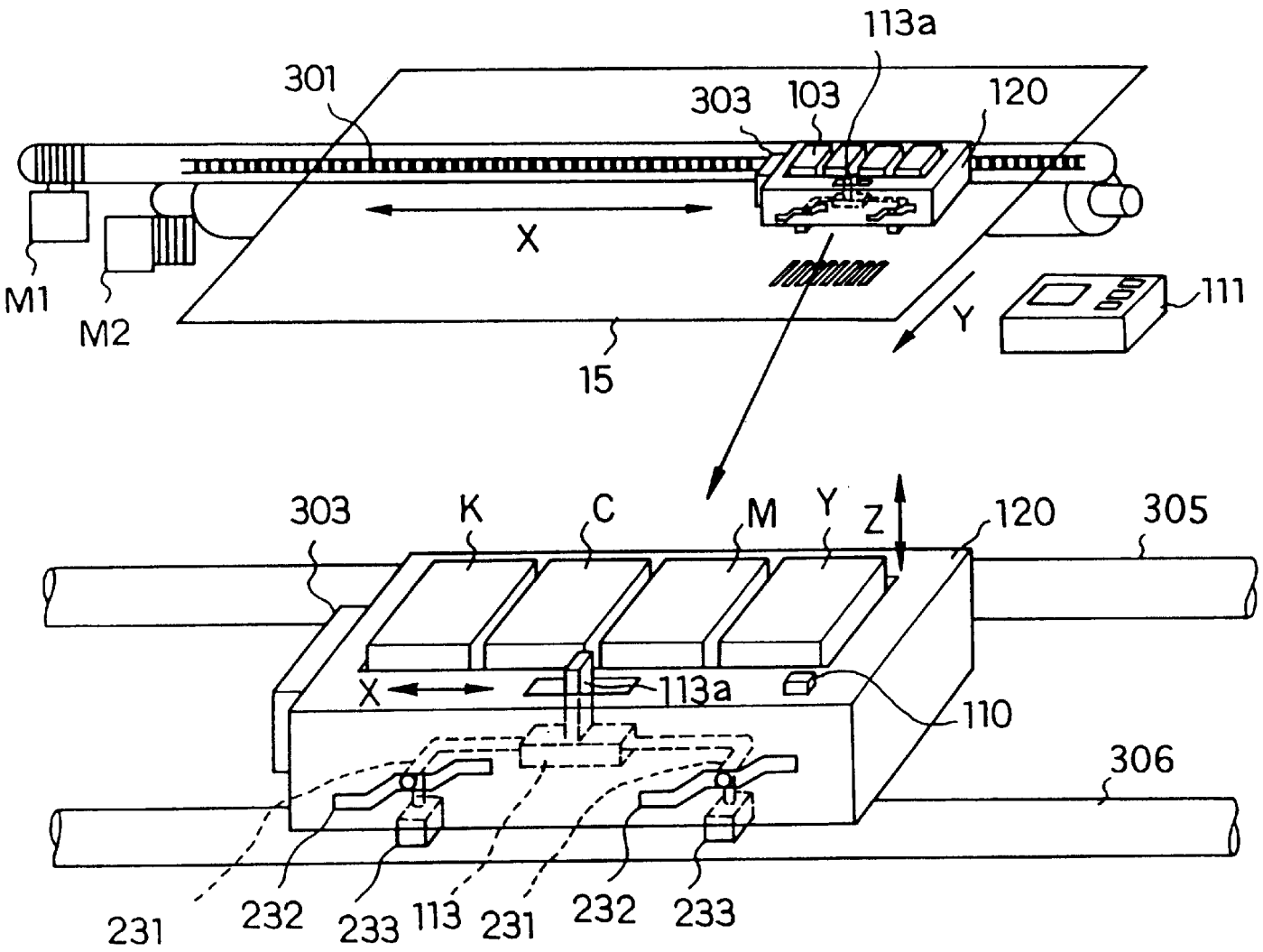
FIG. 2 shows a mechanism for moving a carriage of the embodiment, with a schematic perspective view and an expanded view of the carriage mounted on the mechanism.

FIG. 1 is a block diagram showing a configuration of the ink jet image forming device according to the embodiment. FIG. 2 shows a perspective view of a main part of a carriage moving mechanism of the image forming device and an expanded view of a recording head unit of the mechanism.

As shown in FIG. 1, the image forming device is generally divided into three parts: an external device 101, such as an image scanner, a personal computer, a CAD device, etc. which outputs image data VDI being an image to be recorded, a print control unit 102 for producing signals necessary for forming an image on a recording medium based on the image data VDI which are transferred from the external device 101, and a head 103 for perform a printing based on the signals from the print control unit 102.

The print control unit 102 includes a CPU 104, a head control unit 105, a window control unit 106, a binary conversion circuit 107, an image memory 108, a memory 112, etc. The CPU 104 provides an interface with the external device 101, and controls the entire operation of the print control unit 102 including the image memory 108, the memory 112 and I/O's. The CPU 104 also monitors outputs from a lift height sensor 113, a thermistor 110, and communicates with the head 103 and an operation unit 111. The window control unit 106 performs an operation explained below in response to an output signal LINSCL of the linear sensor 302. The binary conversion circuit 107, responsive to an output signal So from the paper sensor 303, performs the binary conversion. The CPU 104 detects the side edge position of the paper sheet based on the binary converted output.

As shown in FIG. 2, the linear scale 301 is fixed to the main body of the image forming device and a carriage 120 is provided movably back and forth along the linear scale 301. At the left side of the carriage 120, a paper sensor 303 is mounted which acts to detect a side edge of a paper sheet. The carriage 120 has four heads 103 mounted thereon, from the side of the paper sensor 303, in the order of K (black), C (cyan), M (magenta) and Y (yellow). Numeral 111 indicates an operation unit being an interface with a user, with which the user can arbitrarily issue commands for selecting a print mode, exchanging a head, for performing an ink clogging recovery, specifying a type of paper, etc. The instruction from the operation unit 111 is recognized by the CPU 104, which in turn transfers the instructed operation to the heads 103 and the head control unit 105.

Along the scanning direction X of the carriage 120, a pair of rails 305 and 306 are disposed in parallel. At the bottom of the carriage 120, two guide members 233 are fixed along the direction perpendicular to the rail 306, so that the guide members 233 are supported slidably along the rail 306 back and forth in the scanning direction X. Disposed on the guide members is the carriage 120, a lever 113*a* on which is movable leftward or rightward so as to change the height of the carriage 120 relative to the guide member 233 in a Z direction in three steps of upper, medium and lower. Numeral 113 indicates a lift height sensor which detects how far the heads 103 on the carriage 120 are away from a paper sheet. The lift height sensor 113 can be constituted by a volume resistor, a detector switch or the like which is operated by the motion of the lever 113*a*. On the upper surface of the carriage 120, a thermistor 110 is placed to detect an ambient (environmental) temperature. By monitoring the detected result of the thermistor 110, it is recognized at what degree of temperature the image forming device is now operated and by what amount the temperature has risen or fallen relative to the previous temperature.

In FIG. 2, M1 indicates a motor for driving the carriage 120 in the X direction and M2 indicates another motor for moving a paper sheet 15 in the Y direction.

Figure 3:
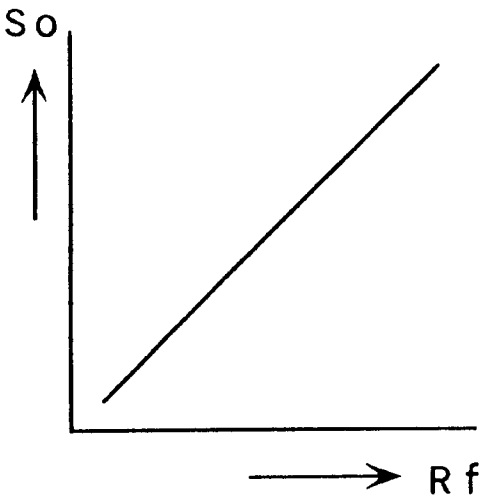
FIGS. 3(*a*), 3(*b*) and 3(*c*) are graphs showing an output of a paper sensor, which changes depending upon various factors: a reflectance of a paper sheet, an ambient temperature, a lift height, respectively.
Figure 3:
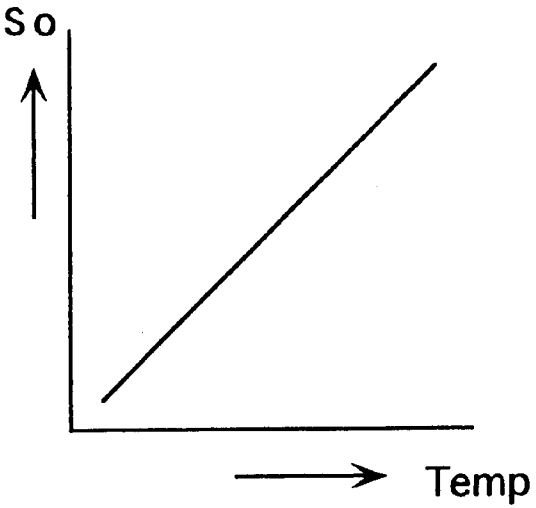
Figure 3:
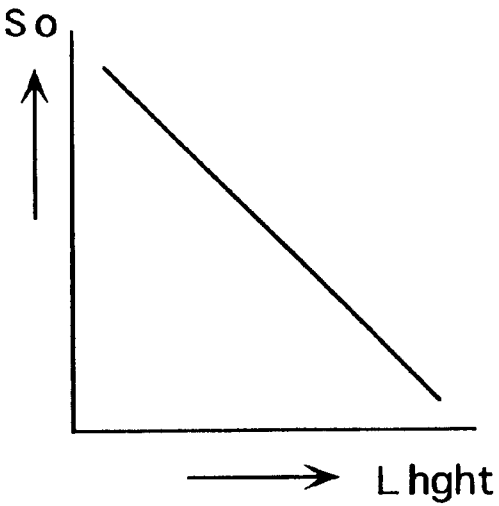

FIGS. 3(*a*), 3(*b*) and 3(*c*) are graphs representing an output So of the paper sensor 303 with respect to a reflectance Rf of paper, an ambient temperature Temp, and a lift height Lhght of the heads, respectively. As shown in FIG. 3(*a*), the stronger is the light reflected from a paper sheet (higher reflectance of the paper sheet), the higher is the output of the paper sensor. Similarly, as shown in FIG. 3(*b*), the higher is the ambient temperature, the higher is the paper sensor output. Also, as shown in FIG. 3(*c*), the greater is the lift height of the heads, the lower is the paper sensor output.

Figure 12:
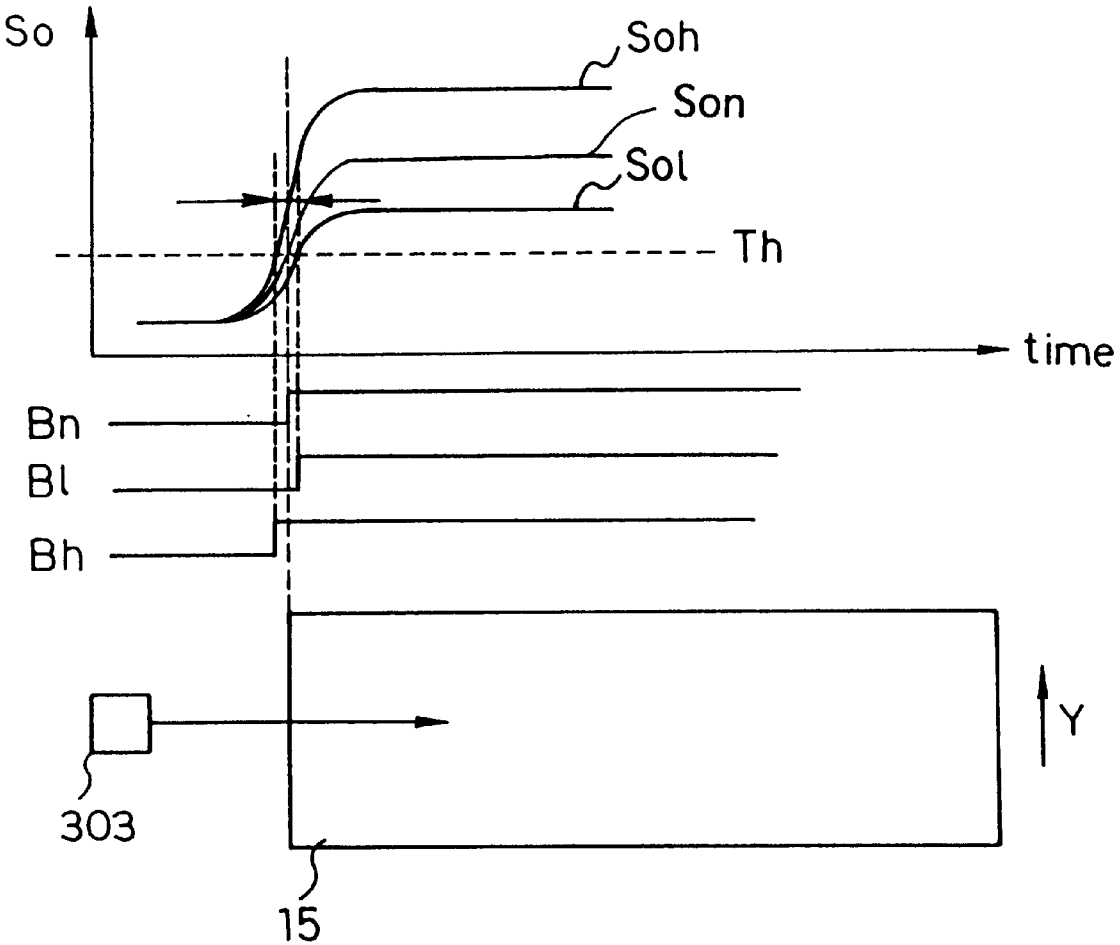
FIG. 12 is a diagram for explaining the characteristics of the paper sensor and problems in a prior art ink-type image forming device.
Figure 13:
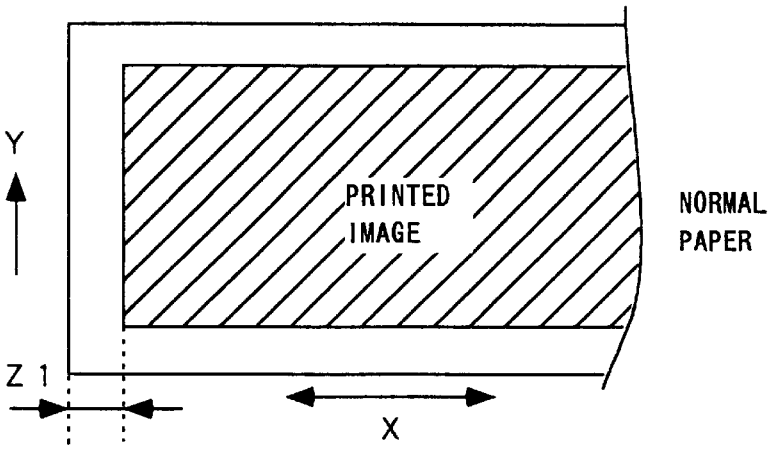
FIG. 13 shows a printed result of the prior art inktype image forming device.
Figure 13:
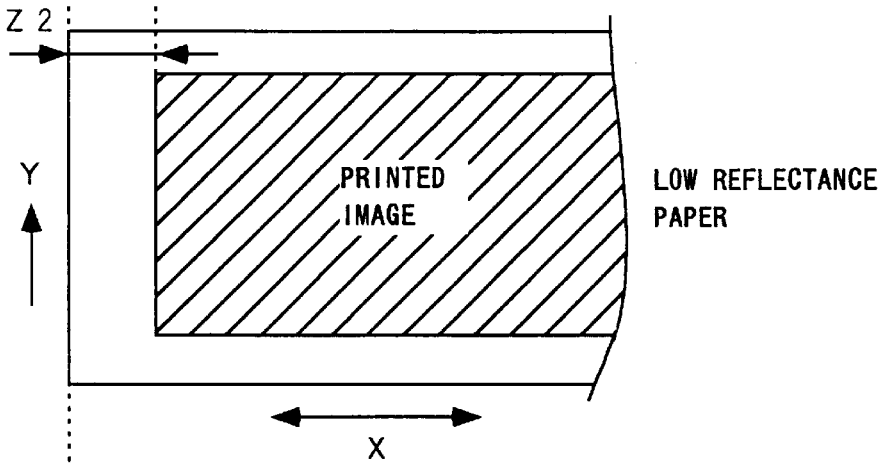
Figure 13:
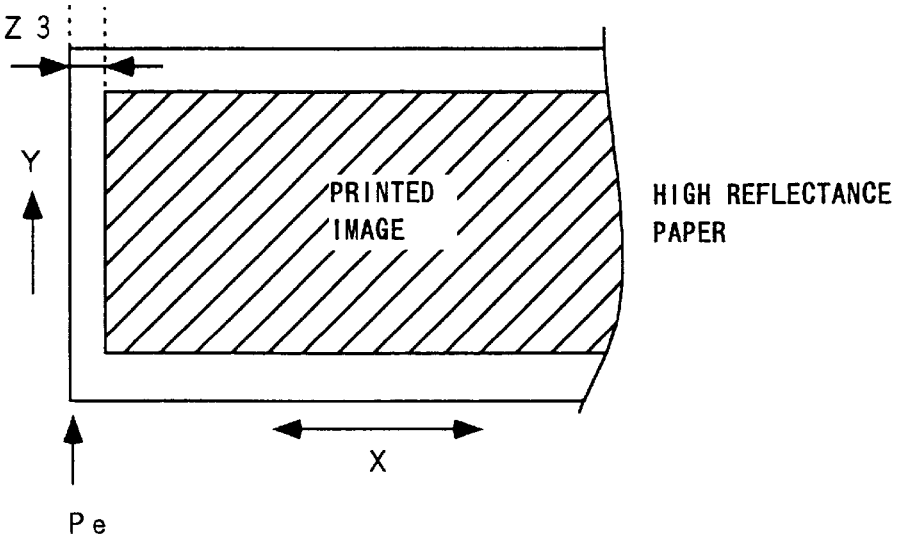

Therefore, when converting the paper sensor output into a binary signal with a fixed threshold level, the detected position of the paper edge varies as described above (see FIGS. 12 and 13(*a*)–(*c*)), and hence, the print start position will vary depending upon the type of paper, the ambient temperature and the lift height. To overcome this, there are provided the thermistor 110 for detecting the ambient temperature, the operation unit 111 for a user to set up a type of paper, and a lift height sensor 113 for detecting the lift height of the heads, as mentioned above, so as to perform a control of correcting the print start position based on the ambient temperature, the type of paper and the lift height.

In the present embodiment, as shown in FIG. 4, conversion tables 401, 402 and 403 are placed in the memory 112 (FIG. 1), which respectively store a correction amount Ct (FIG. 4(*a*)) for correcting open/close timings of window signals (mentioned below) which are generated by the window control unit 106 in response to a variation amount of the ambient temperature, a correction amount Cp (FIG. 4(*b*)) for correcting the same in response to the type of paper, and a correction amount Ch (FIG. 4(*c*)) for correcting the same in response to the lift height. In the example shown in FIG. 4, with respect to the ambient temperature, correction amounts from −8 dots to 2 dots are prepared at 9 steps from 0 degree to 40 degrees at an interval of 5 degrees. With respect to the type of paper, correction amounts from +4 dots to −4 dots are prepared at an interval of 2 dots, for 5 types of paper. Further, with respect to the lift height, correction amounts from +4 dots to −4 dots are prepared at an interval of 4 dots, at three steps as mentioned above. The numbers of the steps and the values of the correction amount are given only by way of example and therefore the present invention is not limited to these specific numbers and values. In addition, instead of providing the conversion tables 401, 402 and 403 which store therein the correction amounts, the correction amounts can be embedded beforehand in a program for executing the print process (explained below), as parameters which correspond to various conditions.

Figure 5:
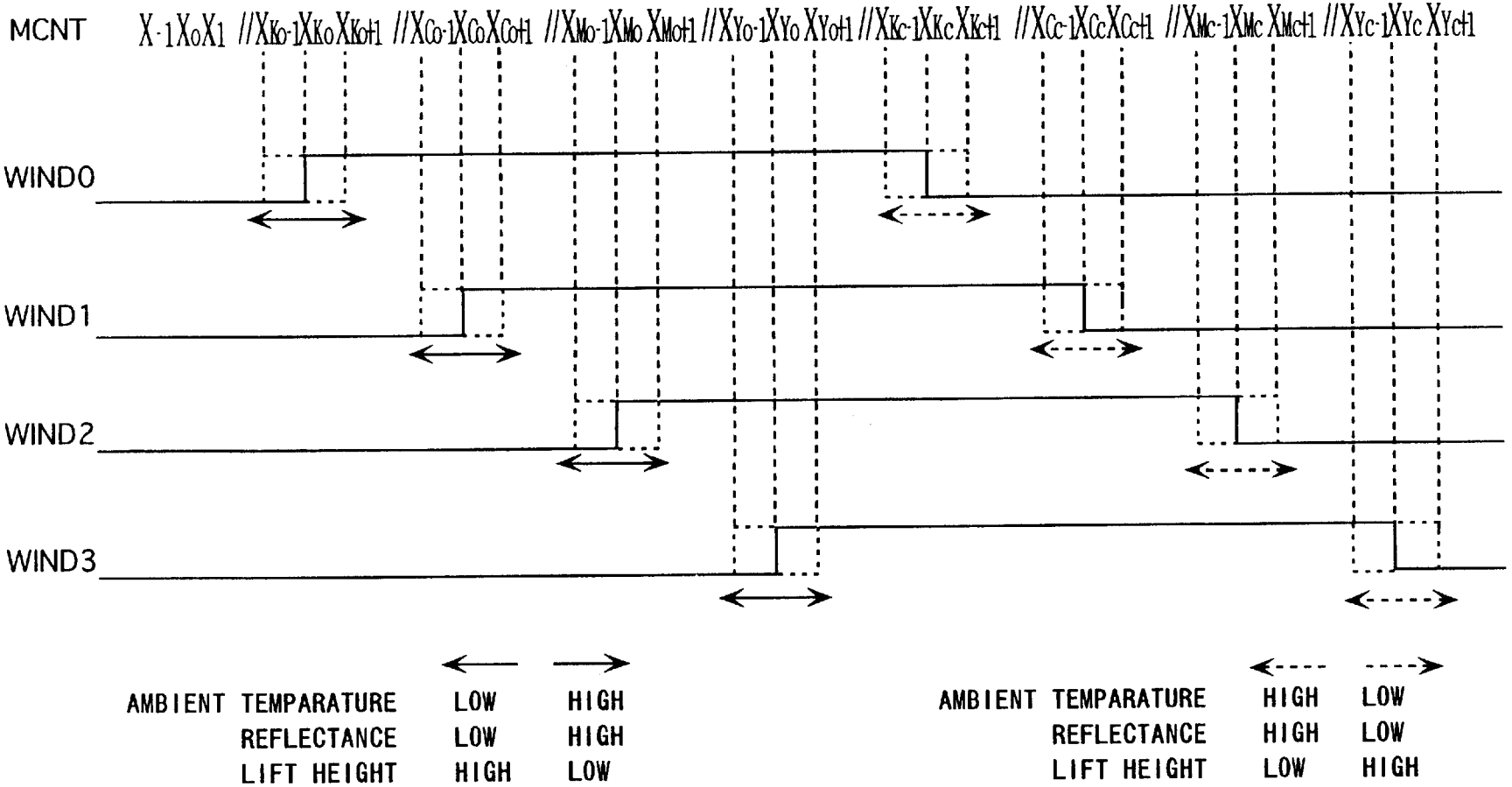
FIG. 5 shows how print start/end timings of a head in the horizontal direction are corrected with respect to the various factors as shown in FIG. 3(*a*), 3(*b*) and 3(*c*)

Responsive to the detected temperature from the thermistor 110, the type of paper designated from the operation unit 111, and the output from the lift height sensor 113, the CPU 104 corrects the data, which determine ink-eject start/end positions for each head 103, to be set in the CPU I/F unit 802 (FIG. 7) of the window control unit 106 (mentioned below). Thus, as shown in FIG. 5, the window signals WIND 0–3 of the respective heads K, C, M and Y are corrected in their timings so as to modify the print start/end positions (as indicated by the arrows directed rightward and leftward). (In FIG. 5, MCNT indicates a count value of the pulse output from the linear sensor 302.) As a result, proper margins can be maintained in spite of the variation of the ambient temperature, the type of paper and the lift height. More specifically, at the left edge of a paper sheet, when the ambient temperature is low, when the paper reflectance is low and when the lift height is high, the correction is performed so as to make the rising and falling timings of the respective windows earlier. Reversely, when the ambient temperature is high, when the paper reflectance is high and when the lift height is low, the correction is performed so as to make the rising and falling timings of the respective windows later. Likewise, at the right side edge of the paper sheet, the correction is made in the opposite direction for the respective cases. This is because the detection error occurs in the opposite direction, at the left and right edges of the paper sheet. That is, when the left side paper edge is detected at an inner position than the actual paper edge position, the right side edge position is also detected at an inner position than the actual position.

In the embodiment, both the left and right paper edges are detected for an image forming device capable of handling an indefinite size of paper. However, if only definite sizes of paper are handled, it may be sufficient to detect only the paper edge at one side.

Now, an operation of the embodiment will be explained below, dividing it into (1) a general operation of the device and (2) detailed operations of the respective units.

(1) General Operation of The Ink-type Image Forming Device

Referring to FIG. 1, upon receipt of serial image data VDI from the external device 101, the head control unit 105 temporarily stores several bands of the serial image data VDI into the image memory 108 in response to an instruction from the CPU 104. The stored image data VDI are subjected to various image processing and then image data VDO are output in synchronism with the scanning of the heads 103.

Figure 10:
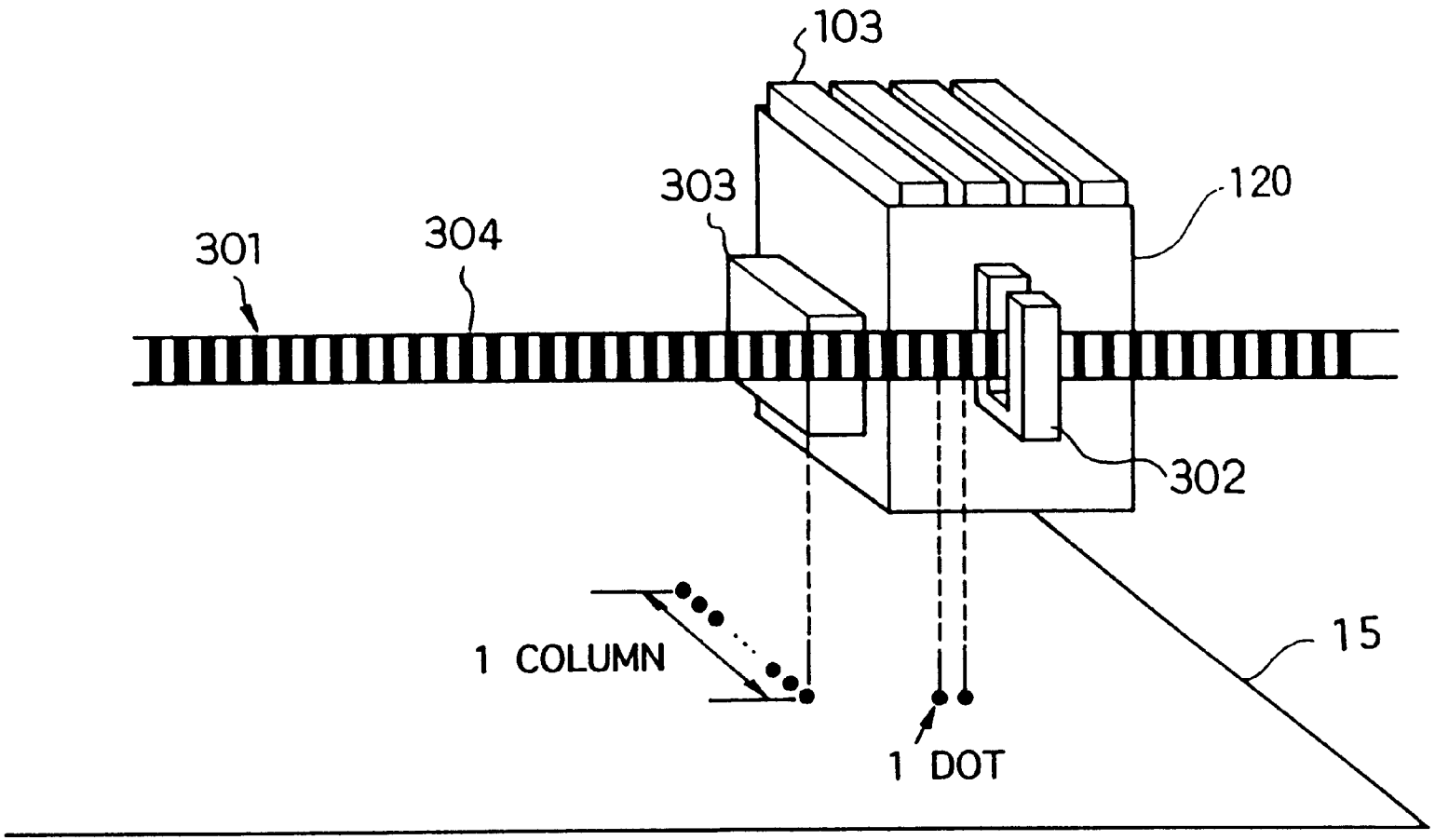
FIG. 10 is a diagram showing an arrangement of a linear scale, slits and a paper sensor in prior art.

By using the signal LINSCL which is output in synchronism with the scanning of the heads 103 from the linear sensor (302 in FIG. 10) moving along the linear scale 301, the synchronization of outputting the image data VDO is maintained while the travelled distance of the heads 103 are output by a counter (801 in FIG. 7) in the window control unit 106, which will be explained next.

The window control unit 106 generates window signals (area signals) WIND 0–4 (see FIG. 6) each indicating a printable region from the print start position to the print end position, and makes a synchronization signal valid only within the enabled region of the window signal. These signals WIND 0–4 are generated as follows. The CPU 104 sets up the start and end positions for the respective heads 103, taking into consideration the spacings between the mounted positions thereof, and performs a control so that when the travelled distances of the respective heads from a reference position reach positions set by the CPU, the respective signals WIND 0–4 are enabled.

The head control unit 105 also generates signals necessary for ejecting ink drops, such as signals BENB 0–7 for enabling blocks in each head (eight block enable signals are present in the embodiment since 128 nozzles of each head are divided into eight blocks) and heater driving pulse signals HENB. These signals are known and not directly relevant to the invention, and hence, the details will not described here.

Figure 9:
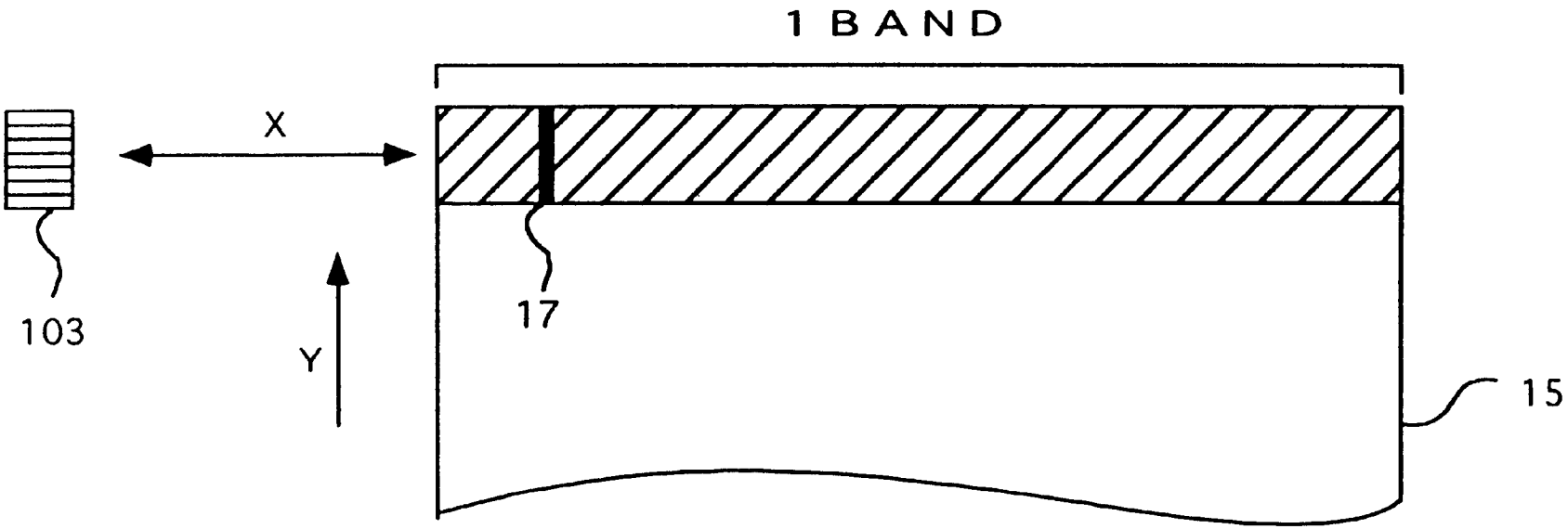
FIG. 9 is a diagram for explaining a prior art method of printing.

The image data VDO, the block enable signals BENB 0–7 and the heater driving pulse signals MENB from the head control unit 105 are transferred to each head 103, where the control circuit in the head 103 drives ON the heaters of only the nozzles whose image data VDO and enable signals (BNEB, HENB) are enabled to eject ink drops onto a paper sheet, forming a column of image and then forming a band of image by scanning the heads 103 in the main scanning direction X as mentioned above (see FIG. 9).

In the embodiment, a full color printing is realized by using four sets of the head control unit 105 and the head 103, with cyan, magenta, yellow and black ink tanks (each ink tank is integrated with the respective head in this embodiment). (In the description below, an explanation will be given only with respect to one set of them.) As explained above, the heads 103 and the paper sensor 303 (see FIG. 10) are scanned on a paper sheet. The output of the paper sensor 303 is compared with a threshold level in the binary conversion circuit 107 to be converted into a binary signal, based on which the CPU 104 decides whether a paper sheet is present or absent. The CPU 104 monitors the binary converted output of the linear sensor 302, while also monitoring the count value of the output from the linear sensor 302, at the time the paper sheet is detected, so as to recognize where in the horizontal direction what size of paper sheet has been loaded. Further, in forming an image on the paper sheet, as mentioned above, based on the position of the paper sheet (the count value of a pulse output from the linear sensor), the print start and end positions are determined according to the present positions of the paper sensor 303 and each head 103, taking into consideration a margin from the paper edge position Pe and the distances of each head from the paper sensor 303.

Also as mentioned above, in order to prevent the heads to rasp the surface of a paper sheet due to the swelling and heaving of the paper sheet depending on a print density, the carriage 120, on which the heads are mounted, is provided with the lever 113*a* for switching the height of the heads 103 where the guide members 233, ganged with the motion of the lever 113*a*, cause the heads 103 to move up or down to change the height of the heads. The height of the heads at that time is detected by the lift height sensor 113, which is then recognized by the CPU 104.

(2) Detailed Operation of the Respective Units

The above described window control unit 106, paper sensor 303, thermistor 110, operation unit 111 and lift height sensor 113 are the elements which perform the most characteristic operation in the invention. With these elements, the paper edge position Pe detected by the paper sensor 303 and the linear sensor 302 is corrected based on the type of paper specified at the operation unit 111, the ambient temperature detected by the thermistor 110, and the lift height detected by the lift height sensor 113, thereby controlling the print start/end positions according to the corrected result. This is, as stated above, to overcome the problem that the detected paper edge position fluctuates, which displaces the print start position to change the margin, depending upon the type of paper, the ambient temperature and the lift height.

An explanation will be given of each element hereinafter.

Figure 7:
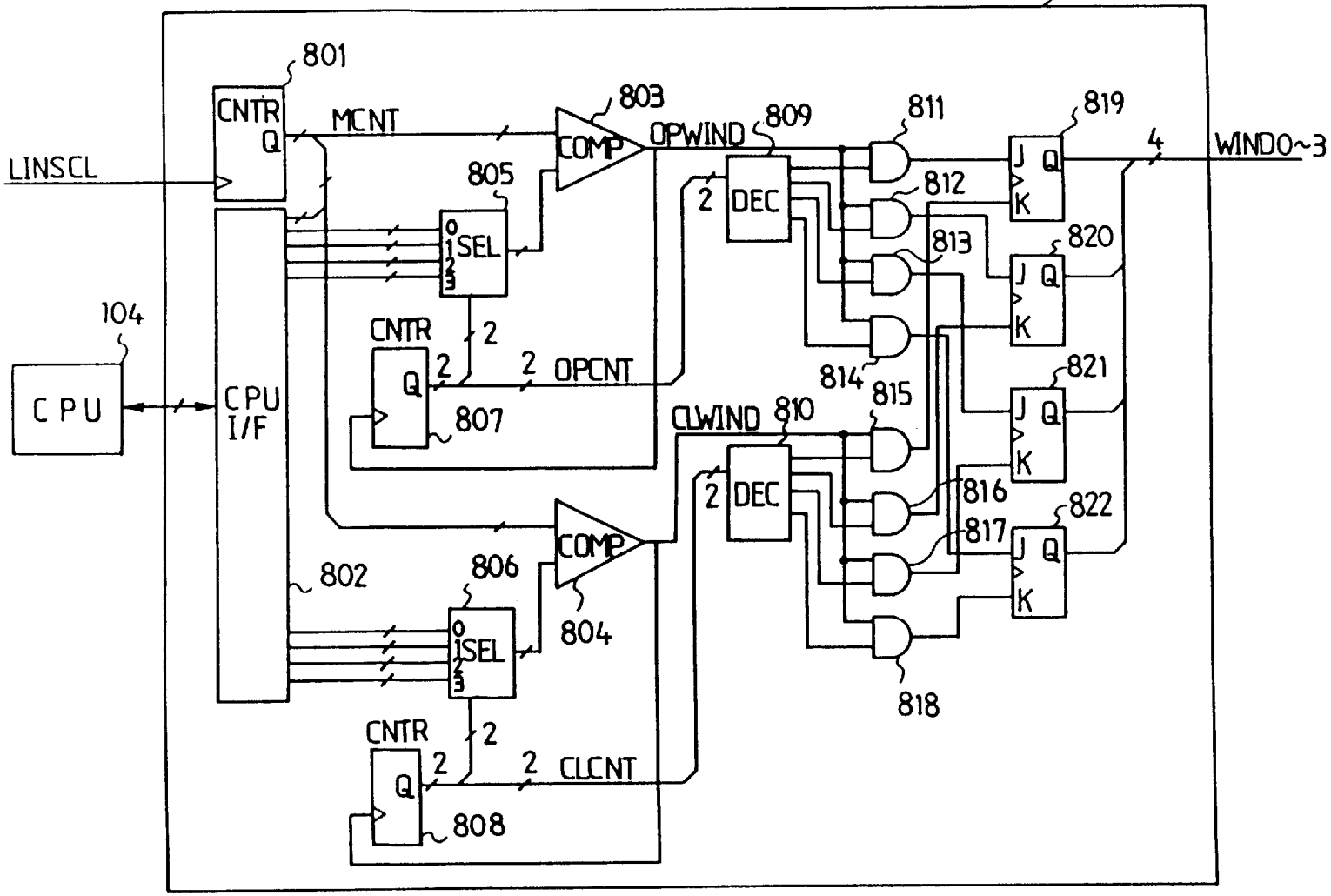
FIG. 7 is a diagram of a circuit which generates print start/end timings of the head in a main scanning direction (horizontal direction) in the embodiment.

Referring to FIG. 7, there is shown a circuit diagram which represents the configuration inside the window control unit 106. In FIG. 7, numeral 801 denotes a multi-bit counter; numeral 802 denotes a CPU I/F unit; 803–804, multi-bit comparators; 805–806, selectors; 807–808, two-bit counters; 809–810, decoders; 811–818, AND circuits; and 819–822, J-K flip-flops.

The multi-bit counter 801 counts, as a clock input, the pulse signal LINSCL from the linear sensor 302 which moves together with the heads 103, and detects a travelled distance MCNT of the heads 103 from the reference position. The travelled distance MCNT is monitored through the CPU I/F unit 802 by the CPU 104.

Also, the CPU 104 stores, in the CPU I/F unit 802, data corresponding to the ink eject start/end positions (i.e., open/close positions of the window) for each head. The selector 805 operates so as to sequentially select the data indicative of the window open positions for the respective heads at predetermined regular intervals from the first head to the last (in the order of the inputs 0, 1, 2 and 3). Also, the selector 806 operates so as to sequentially select the data indicative of the window close positions for the respective heads at predetermined regular intervals from the first head to the last (in the order of the inputs 0, 1, 2 and 3). The data setting to the CPU I/F unit 802 is performed in this manner. In the embodiment, since the heads are mounted in the order of black, cyan, magenta and yellow as mentioned above, the data are set in this order.

As the printing is started and the heads 103 move, the travelled distance MCNT outputted from the multi-bit counter 801 is compared, at the multi-bit comparators 803 and 804, with the data of the ink eject start or end positions set in the CPU I/F unit 802 with respect to the respective heads. First, when the carriage 120 reaches the position represented by the window open data which have been specified with respect to the first head of black, a window open signal OPWIND becomes high "H", causing the 2-bit counter 807 to count up at the same time to update an open identifying signal OPCNT to "1H" (here, "H" indicates a hexadecimal). (The initial value of the 2-bit counter 807 is zero.) Thus, the input to the multi-bit comparator 803 is switched to the input 1 of the selector 805 (data prepared for the second head), resulting in that the window open signal OPWIND goes back to a low level "L". Subsequently, when the carriage 120 reaches the open position of the second head following the first head, the window open signal OPWIND becomes high "H", causing the 2-bit counter 807 to count up to "2H", and the input to the multi-bit comparator 803 to change to the input 2 of the selector 805 (data prepared for the third head). As a result, the window open signal OPWIND changes back to "L". Further, when the carriage 120 reaches the open position of the third head, the window open signal OPWIND becomes high "H", causing the 2-bit counter 807 to count up to "3H", and the input to the multi-bit comparator 803 to change to the input 3 of the selector 805 (data prepared for the fourth head). As a result, the window open signal OPWIND changes back to "L".

The window close signal CLWIND operates, when the carriage 120 comes near the terminated edge of the paper sheet, together with the selector 806 and the comparator 804 in the same manner as the window open signal OPWIND.

Figure 6:
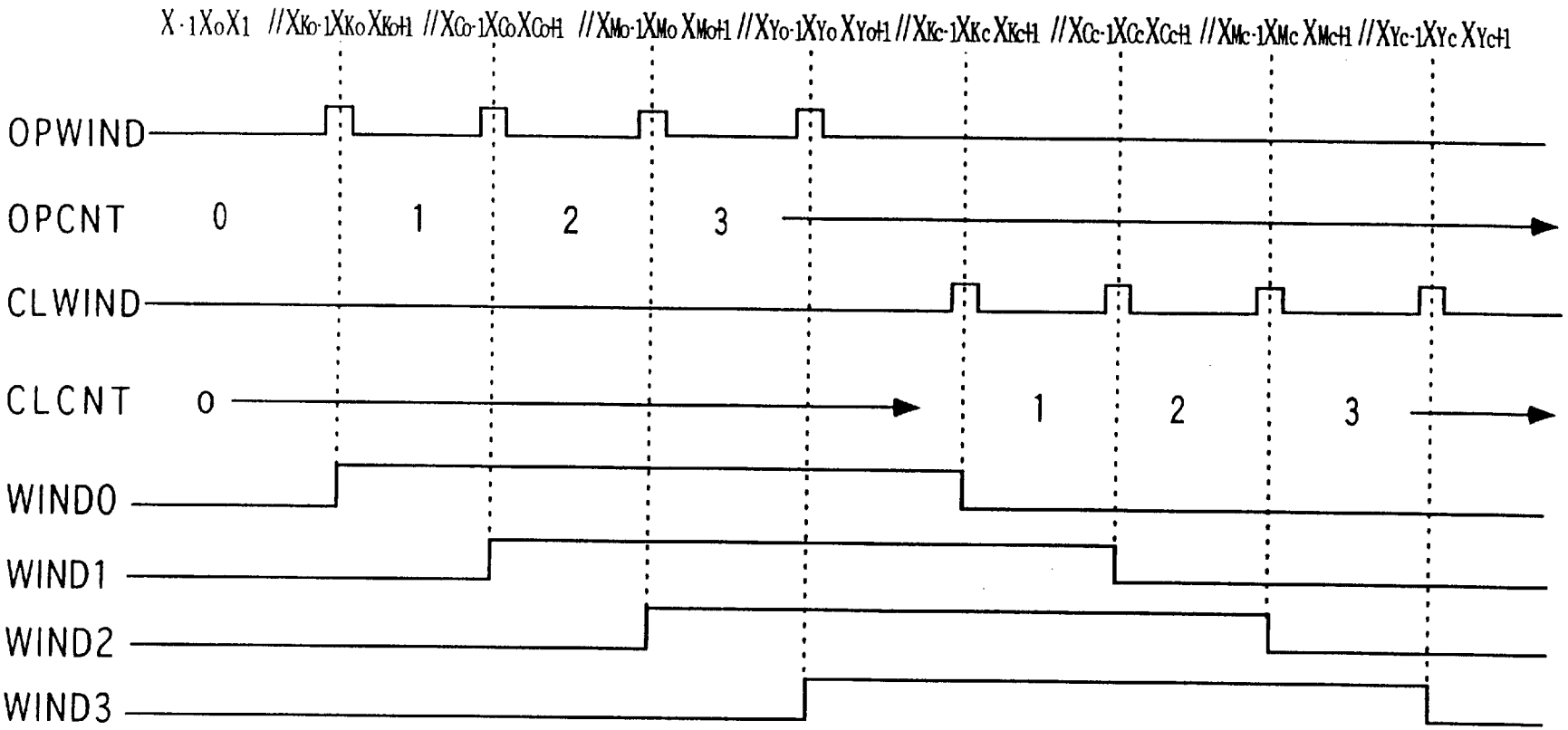
FIG. 6 is a diagram showing specifically print start/end timings of the head in the horizontal direction.

With the foregoing operations iterated, generated are the window open signal OPWIND and the window close signal CLWIND, as well as the open identifying signal OPCNT and close identifying signal CLCNT which are signals for identifying which one of the four heads is to be opened or closed. The identifying signals OPCNT and CLCNT are applied respectively to the decoder 809 and 810, and AND circuits 811–818. Thus, depending upon the head identifying signal OPCNT and CLCNT, the open/close timing signals are distributed to the respective heads. The timing signals distributed to the respective heads act to set and reset the J-K flip-flops 819–822 as shown in FIG. 6, to generate the window signals WIND 0–3 for the respective heads.

Figure 8:
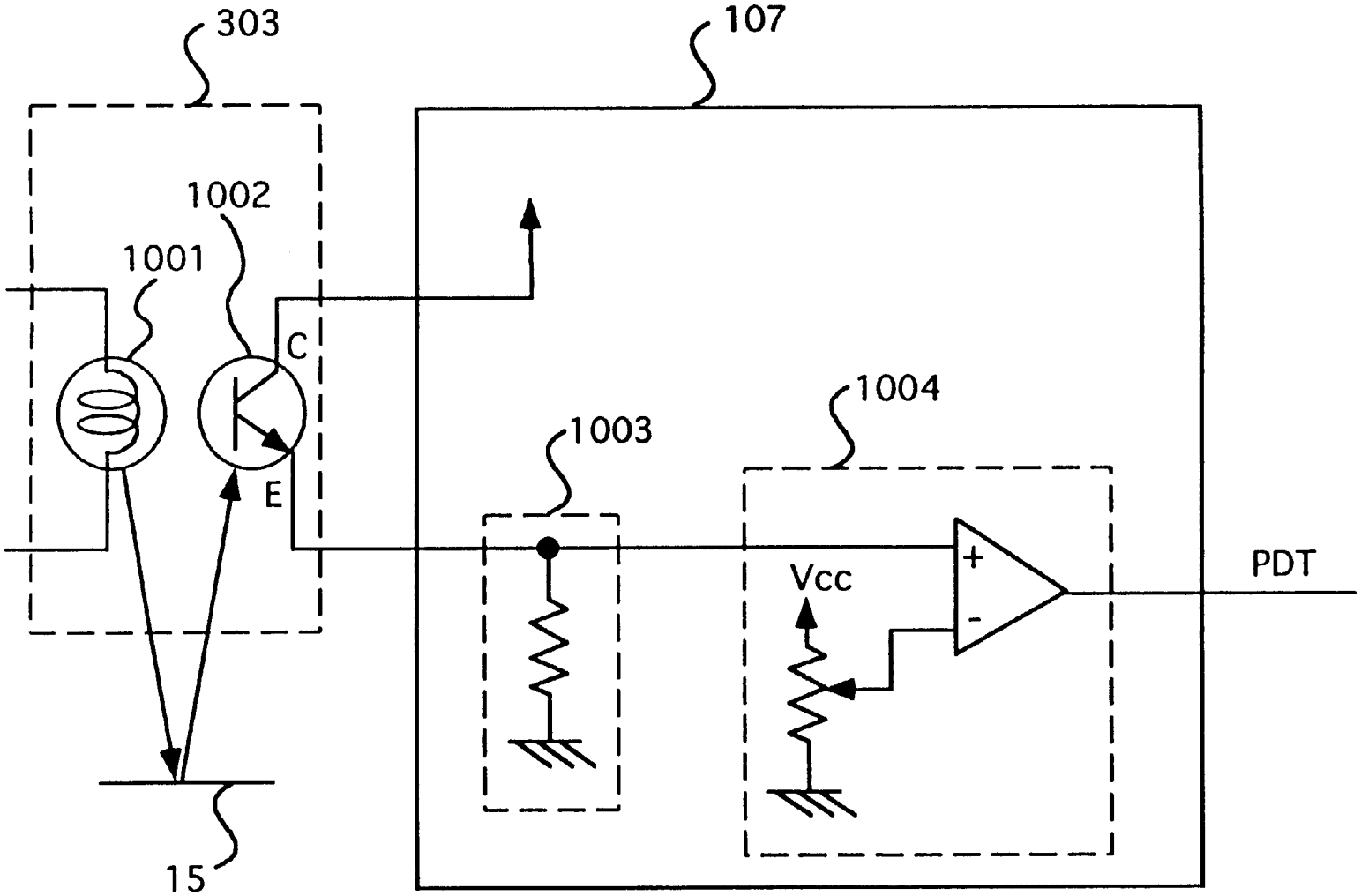
FIG. 8 is a diagram of a circuit which processes an output signal from a paper sensor in the embodiment.

Referring next to FIG. 8, a detailed explanation will be given of the paper sensor 303 and the binary conversion circuit 107. The paper sensor 303 in the embodiment is a detector which photo-electrically detects the presence of a paper sheet. In FIG. 8, numeral 1001 denotes a light emitting unit which is constituted by a lamp or LED; numeral 1002 denotes a light receiving unit which is constituted by a photo-transistor or photo-diode; 1003, an emitter resistor; and 1004, a comparator. The light emitting unit 1001 emits light on to a paper sheet during the scanning of the heads 103, and the reflected light is received by the light receiving unit 1002. The voltage generated at the end of the emitter resistor 1003 is converted with a threshold level into a binary signal at the comparator 1004, so as to detect the presence/absence of a paper sheet. By monitoring the count value of the linear sensor 302 (FIG. 10) at the time the presence/absence of the paper sheet is detected, it is recognized where in the horizontal direction what size of paper has been loaded.

Figure 14:
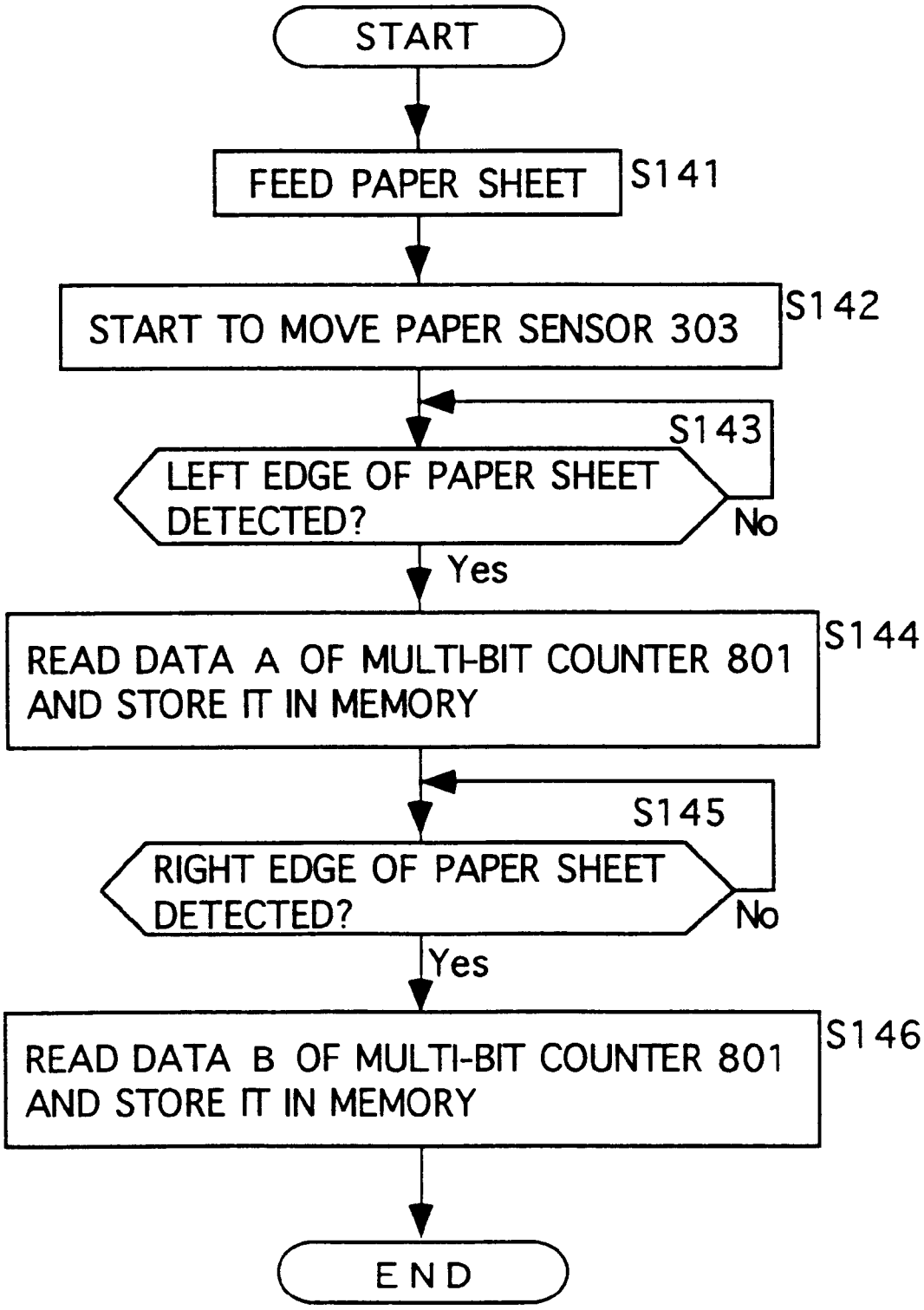
FIG. 14 is a flow chart showing a process of detecting a paper edge in the embodiment.

FIG. 14 shows a flow chart of a paper edge detection process which is executed by the CPU 104. This paper edge detection process is a process which is executed prior to the starting of a new printing process (e.g., a printing process of a document).

First, a paper sheet is loaded (S141) and then the paper sensor 303 together with the carriage is started to move from the reference position in the main scanning direction X (S142). In this event, the output from the linear sensor 302 is counted by the multi-bit counter 801 (FIG. 7) to wait until the left edge position of the paper sheet is detected based on the output of the paper sensor 303 (S143). Upon detection of the left edge position of the paper sheet, data A from the multi-bit counter 801 at that time is read out to be stored in the memory 112 (FIG. 1) (S144). Then, the carriage 120 continues to move until the right edge position of the paper sheet is detected based on the output of the paper sensor 303 (S145). At the time the right edge position of the paper sheet is detected, data B from the multi-bit counter 801 is read out to be stored in the memory 112 (S146).

Figure 15:
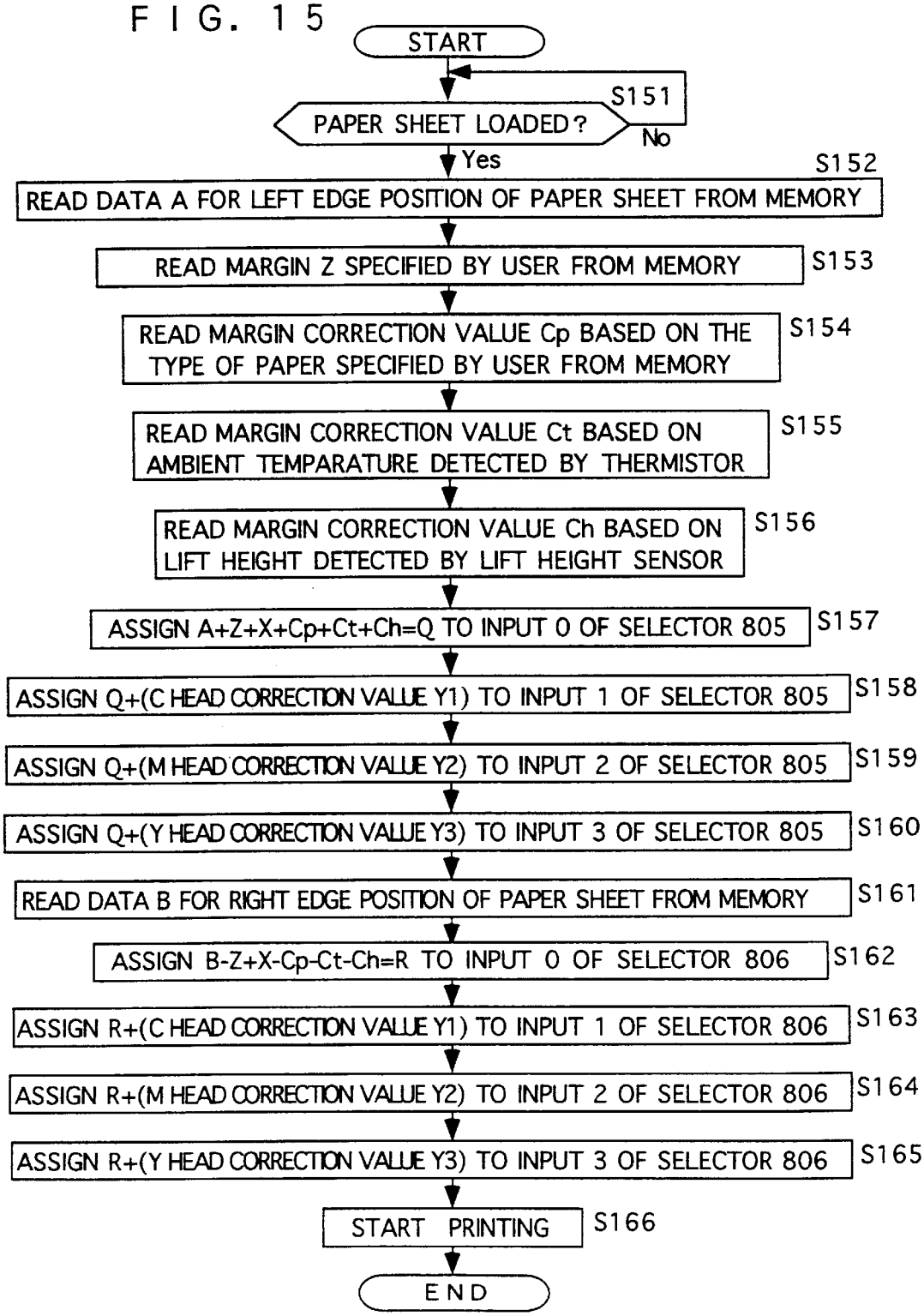
FIG. 15 is a flow chart showing a printing process in the embodiment.

Referring next to FIG. 15, there is shown a flow chart of a printing process which is executed by the CPU 104.

First, the completion of loading a paper sheet is waited (S151). After the completion of the loading, the data A of the left edge position of the paper sheet is read out of the memory 112 (S152). Then, a margin amount Z is read out which has been designated by a user (S153). This margin amount Z has already been stored in the memory 112 at this point of time. When the margin amount is to be different at the left and right sides, separate margin amounts for the both sides are read out.

Subsequently, based on the type of paper which has been designated by the user, a margin correction amount Cp, which is determined according to the relationship defined in FIG. 4(*b*), is read out of the table 402 (S154). Then, based on the ambient temperature detected by the thermistor 110, a margin correction amount Ct, which is determined according to the relationship defined in FIG. 4(*a*), is read out of the table 401 (S155). Similarly, based on the lift height detected by the lift height sensor 113, a margin correction amount Ch, which is determined according to the relationship defined in FIG. 4(*c*), is read out of the table 403 (S156).

Next, a value is calculated from an equation, Q=A+Z+X+Cp+Ct+Ch, which value is set in the CPU I/F unit 802 so as to assign the value to the input 0 location of the selector 805 (S157). This value Q corresponds to the print start position (window open position) of the black (B) head. The data A of the paper left edge position is corrected with a sum of the three correction values Cp+Ct+Ch, and hence, the designated margin amount is accurately realized.

Figure 11:
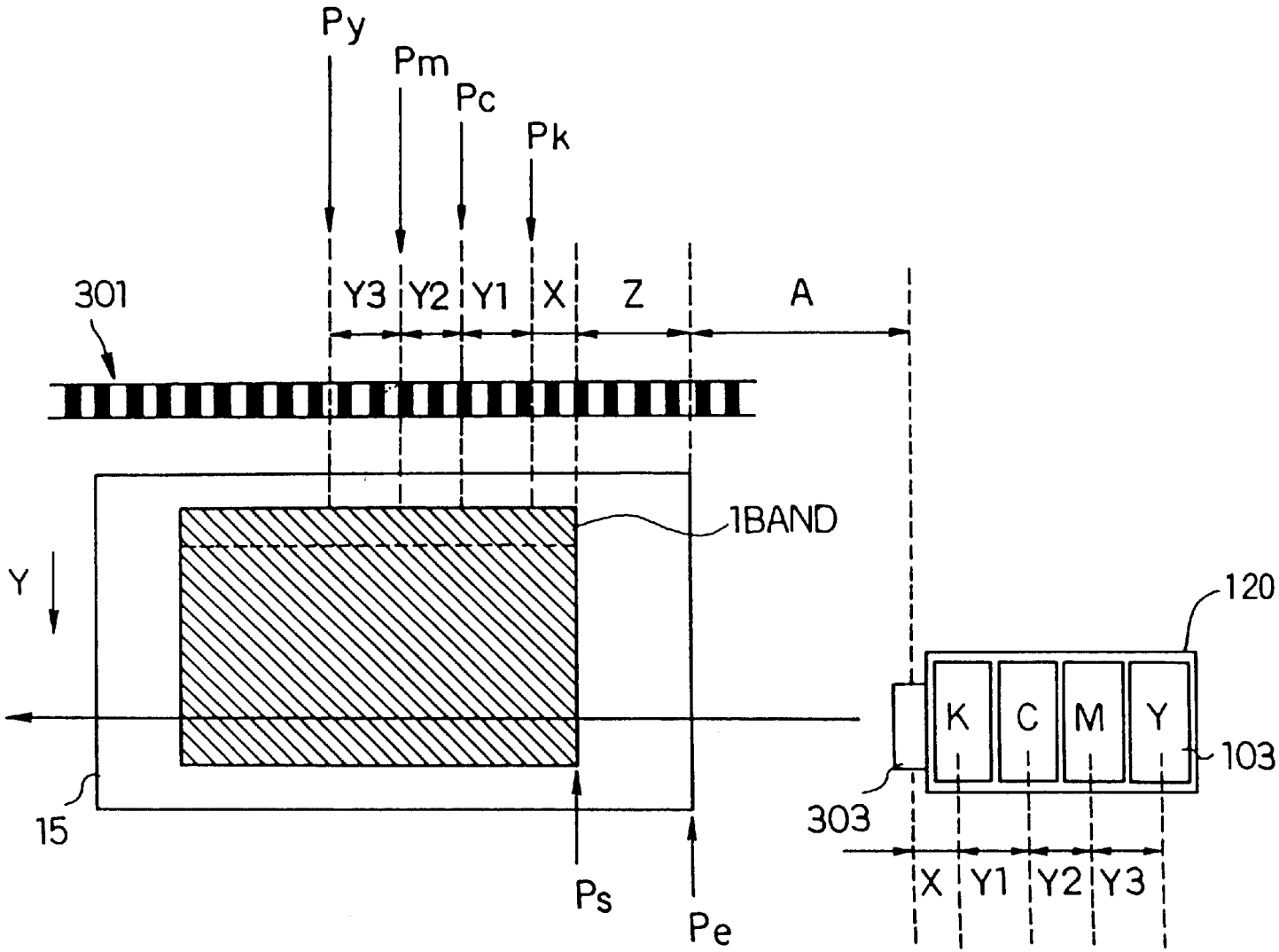
FIG. 11 is a diagram which shows print start timings of respective heads of plural colors.

Subsequently, values obtained by separately adding the Q value with a C head correction amount Y1, an M head correction amount Y2, and a Y head correction amount Y3 (see FIG. 11) are set in the CPU I/F unit 802 so that the values are assigned to the input 1, 2, 3 locations, respectively, of the selector 805 (S158–S160). These assigned values correspond to the print start positions (window open positions) of the C, M and Y heads, respectively.

Then, the data B of the paper right edge position is read out (S161). Using this data B, a value is calculated from an equation, R=B−Z+X−Cp−Ct−Ch, which value is set in the CPU I/F unit 802 so as to assign the value to the input 0 location of the selector 806 (S162). Here, the correction amounts are subtracted unlike step S157 because the detected error occurs in the opposite direction at the left and right edge of the paper sheet, as mentioned above. The margin amount Z may be different from the previous one, when separate margin amounts are designated at the left and right sides. The R value corresponds to the print end position (window close position) of the black (B) head. Also in this case, the data B of the paper right edge position is corrected with the sum of the three correction values Cp+Ct+Ch, and hence, the designated margin amount is accurately realized.

Subsequently, values obtained by separately adding the R value with the C head correction amount Y1, the M head correction amount Y2, and the Y head correction amount Y3 (see FIG. 11) are set in the CPU I/F unit 802 so that the values are assigned to the input 1, 2, 3 locations, respectively, of the selector 806 (S163–S165). These assigned values correspond to the print end positions (window close positions) of the C, M and Y heads, respectively.

In this way, the setting of all the data to the CPU I/F unit 802 is completed. After this, a printing process is started (S166).

According to the invention, as described above, even any one of the type of paper, the ambient temperature and the spacing from the paper sensor to the paper sheet varies, the paper edge position detected by the paper sensor is corrected based on the respective information, thereby making it possible to control the print start position so as to perform the printing with a proper margin at any time.

INDUSTRIAL APPLICABILITY

The present invention is available to manufacture an image forming device which performs the printing while scanning a recording head in a direction perpendicular to the paper travelling direction.

What is claimed is:

1. An image forming device, comprising:

a carriage for mounting thereon a recording head, said carriage being scanned in a direction perpendicular to a travelling direction of a recording medium;

a scale means for defining recordable dot positions along a scanning direction of said carriage;

a sensor operable with said scale means for detecting each dot position of said scale means;

a counter means for counting dots starting from a reference position based on an output of said sensor moved in said scanning direction;

a recording medium detection means including a light emitting element for emitting light to said recording medium, a light detector for outputting a signal corresponding to an amount of reflected light of said light emitted from said light emitting element, a binary conversion circuit for converting an output of said light detector into a binary signal, and means for reading out a count value of said counter means to detect a side edge of the recording medium based on a change in an output of said binary conversion circuit when said carriage is scanned in the direction perpendicular to the travelling direction of the recording medium;

an event state detection means for detecting a state of an event which is a factor fluctuating the output of said recording medium detection means;

a correction value storage means for storing correction values to correct the read-out count value of said recording medium detection means based on different states of the event detected by said event state detection means; and a correction means for, when recording with the recording head, obtaining one of the correction values corresponding to a state of the event detected by said event detection means, from said correction value storage means, and for correction, with the correction value, said read-out count value as a position of the side edge of the recording medium obtained by said recording detection means.

2. An image forming device according to claim 1, wherein said event state detection means comprises means for detecting an ambient temperature of said image forming device.

3. An image forming device according to claim 1, wherein said event state detection means comprises means for detecting a type of the recording medium which is set up by a user.

4. An image forming device according to claim 1, wherein said event state detection means comprises means for detecting a distance between the recording medium and said detector.

5. An image forming device according to claim 1, comprising a margin control means for controlling, when scanning the recording head in the direction perpendicular to the travelling direction of the recording medium, a margin in the head scanning direction by defining at least a print start position, said margin control means controlling the margin based on the output of said recording medium detection means corrected by said correction means.

6. An image forming device according to claim 1, wherein said detector is fixedly mounted on said carriage.

7. An image forming device according to claim 1, further comprising means for adjusting a distance between said carriage and the recording medium.

8. An image forming device according to claim 1, wherein said event state detection means comprises means for detecting an ambient temperature of said image forming device.

9. An image forming device according to claim 1, wherein said event state detection means comprises means for detecting a type of the recording medium which is set up by a user.

10. An image forming device according to claim 1, comprising a margin control means for controlling, when scanning the recording head in the direction perpendicular to the travelling direction of the recording medium, a margin in the head scanning direction by defining at least a print start position, said margin control means controlling the margin based on the output of said recording medium detection means corrected by said correction means.

11. An image forming device according to claim 2, comprising a margin control means for controlling, when scanning the recording head in the direction perpendicular to the travelling direction of the recording medium, a margin in the head scanning direction by defining at least a print start position, said margin control means controlling the margin based on the output of said recording medium detection means corrected by said correction means.

12. An image forming device according to claim 3, comprising a margin control means for controlling, when scanning the recording head in the direction perpendicular to the travelling direction of the recording medium, a margin in the head scanning direction by defining at least a print start position, said margin control means controlling the margin based on the output of said recording medium detection means corrected by said correction means.

13. An image forming device according to claim 4, comprising a margin control means for controlling, when scanning the recording head in the direction perpendicular to the travelling direction of the recording medium, a margin in the head scanning direction by defining at least a print start position, said margin control means controlling the margin based on the output of said recording medium detection means corrected by said correction means.

14. An image forming device according to claim 1, wherein said detector is fixedly mounted on said carriage.

15. An image forming device according to claim 2, wherein said detector is fixedly mounted on said carriage.

16. An image forming device according to claim 3, wherein said detector is fixedly mounted on said carriage.

17. An image forming device according to claim 4, wherein said detector is fixedly mounted on said carriage.

18. An image forming device according to claim 5, wherein said detector is fixedly mounted on said carriage.

19. An image forming device according to claim 1, further comprising means for adjusting a distance between said carriage and the recording medium.

20. An image forming device according to claim 2, further comprising means for adjusting a distance between said carriage and the recording medium.

21. An image forming device according to claim 2, further comprising means for adjusting a distance between said carriage and the recording medium.

22. An image forming device according to claim 3, further comprising means for adjusting a distance between said carriage and the recording medium.

23. An image forming device according to claim 4, further comprising means for adjusting a distance between said carriage and the recording medium.

24. An image forming device according to claim 5, further comprising means for adjusting a distance between said carriage and the recording medium.

25. An image forming device according to claim 6, further comprising means for adjusting a distance between said carriage and the recording medium.

* * * * *